US009797122B2

(12) United States Patent
Maalouf et al.

(10) Patent No.: US 9,797,122 B2
(45) Date of Patent: Oct. 24, 2017

(54) SHEET CATCHER FOR TOILETS AND METHODS THEREFOR

(71) Applicant: Medline Industries, Inc., Mundelein, IL (US)

(72) Inventors: Sharbel Maalouf, Pleasant Prairie, WI (US); Jonathan Gordon, Highland Park, IL (US)

(73) Assignee: Medline Industries, Inc., Northfield, IL (US)

( * ) Notice: Subject to any disclaimer, the term of this patent is extended or adjusted under 35 U.S.C. 154(b) by 148 days.

(21) Appl. No.: 14/792,389

(22) Filed: Jul. 6, 2015

(65) Prior Publication Data

US 2015/0299997 A1 Oct. 22, 2015

Related U.S. Application Data

(63) Continuation-in-part of application No. 13/915,213, filed on Jun. 11, 2013, now Pat. No. 9,422,700.

(60) Provisional application No. 62/111,848, filed on Feb. 4, 2015.

(51) Int. Cl.
*E03D 9/00* (2006.01)

(52) U.S. Cl.
CPC ..... *E03D 9/00* (2013.01); *Y10T 29/49826* (2015.01)

(58) Field of Classification Search
CPC ..... E03D 9/00
USPC ..... 4/256.1
See application file for complete search history.

(56) References Cited

U.S. PATENT DOCUMENTS

| | | | | |
|---|---|---|---|---|
| 1,051,992 | A * | 2/1913 | Fisher | E03C 1/302 15/104.001 |
| 1,261,444 | A | 4/1918 | Schied | |
| 2,393,603 | A | 1/1946 | Beeth | |
| 2,811,724 | A | 11/1957 | Click | |
| 4,253,211 | A * | 3/1981 | Mockel | E03D 9/00 15/104.32 |
| 5,251,339 | A * | 10/1993 | Piskula | A47K 11/10 15/104.32 |
| 5,769,960 | A | 6/1998 | Nirmel | |
| 6,094,765 | A | 8/2000 | Askenase | |
| 6,775,873 | B2 | 8/2004 | Luoma | |
| D657,099 | S | 4/2012 | Zach et al. | |
| 8,201,281 | B2 | 6/2012 | Hanifl et al. | |
| 8,365,337 | B2 | 2/2013 | Tash | |
| 2006/0059610 | A1 | 3/2006 | Conant | |

OTHER PUBLICATIONS

Le, Huyen "NonFinal OA", U.S. Appl. No. 13/915,213, filed Jun. 2013; Mailed Sep. 28, 2015.

* cited by examiner

*Primary Examiner* — Huyen Le
(74) *Attorney, Agent, or Firm* — Philip H. Burrus, IV

(57) ABSTRACT

An apparatus (100) for a toilet (600) is provided. The apparatus can include a toilet seat engagement portion (101) and a sheet catcher (102) comprising one or more barbs (104,105,106,107,108). A flexible thong (103) can couple the toilet seat engagement portion to the sheet catcher. The sheet catcher to situates within a water seal (605) of the toilet when the toilet seat engagement portion engages a seat (612) of the toilet. The barbs can to catch non-dispersible sheets (701) when the toilet is flushed.

20 Claims, 13 Drawing Sheets

SHEET CATCHER FOR TOILETS AND METHODS THEREFOR

CROSS REFERENCE TO PRIOR APPLICATIONS

This application is a continuation-in-part of U.S. application Ser. No. 13/915,213, filed Jun. 11, 2013, which is incorporated herein by reference for all purposes. This application claims priority under 35 USC 119(e) to Provisional Application Ser. No. 62/111,848, filed Feb. 4, 2015, which is incorporated herein by reference for all purposes.

BACKGROUND

Technical Field

This disclosure relates generally to toilets, and more particularly to devices for toilets.

Background Art

Manufacturers of health care products manufacture cloth wipes and other sheet devices for personal hygiene of patients. For example, wipes and other cloths can be used for cleaning the skin and for dealing with incontinence care. Such wipes are often disposable. Some wipes are designed to breakdown and disperse after use while others are substantially non-dispersible. This non-dispersible property allows them to be used with water during patient cleaning. Additionally, the non-dispersible property allows some cloths to be pre-moistened with rinse-free fluids that clean, moisturize, condition and soothe the skin.

Since they are frequently designed as "single use" items, and as they are frequently used for cleaning patient waste, some may attempt to dispose of these sheets by flushing them down the toilet. For dispersible products, such as toilet paper, this is not a problem since the water in the toilet breaks down the materials of the product. However, for non-dispersible sheets, accumulation in the trapway or other parts of a toilet can lead to a variety of problems, including stoppage of the toilet, blockage of the exhaust system leading away from the toilet, malfunction of septic tanks or sewage systems, or other maladies.

It would be advantageous to have an apparatus to reduce these problems.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
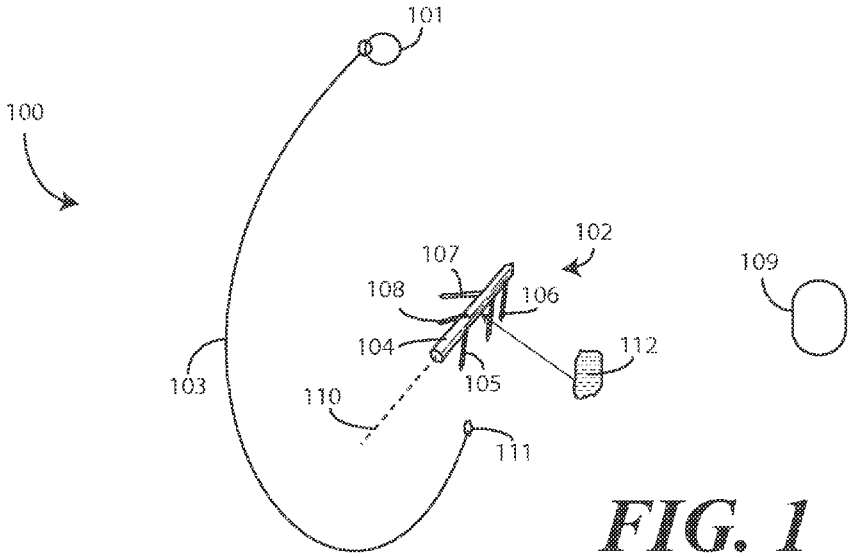
FIG. 1 illustrates a perspective view of one explanatory apparatus in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Prior art attempts at solving the problems described above have been cumbersome, expensive, and difficult to use. For example, U.S. Pat. No. 8,201,281 to Hanifl et al., incorporated herein by reference, discloses a trapping device for non-dispersible cloths. In the '281 patent, a trapping device involves wrapping a metal strap into a circle. The strap must then be permanently installed into the trapway of a toilet bowl with a screw. A staple leg, which is a bent piece of strap metal, then attempts to catch non-dispersible cloths about its perimeter, while allowing other materials to pass through.

In practice, the strap of the '281 patent has problems. First, the strap must be permanently installed by a specialized technician. Next it requires a special sizing tool to form the strap to the proper size. Once installed, a person must reach into the water with a special set of pliers to remove a protective foam ring. Each of these steps is very user-unfriendly. The steps are also costly and time consuming.

The foremost problem with the strap of the '281 patent is that when non-dispersible cloths are captured, a user must reach into the bowl with a retriever to "unsnag" the non-dispersible cloths from the strap. This is a tedious and sometimes unsanitary chore, can result in the user actually pushing the non-dispersible cloth further into the trapway or into the exhaust completely. At a minimum it requires the user to place their hands in an unsanitary position.

Embodiments of the disclosure provide a simpler, less expensive, faster, and more user-friendly apparatus and method for catching non-dispersible sheets. In one embodiment, an apparatus includes a toilet seat engagement portion, a sheet catcher that includes one or more barbs, and a flexible thong coupling the toilet seat engagement portion to the sheet catcher. The toilet seat engagement portion can be manufactured from a thermoplastic or other similar material. The flexible thong can be manufactured from a metal or synthetic cable, metal or synthetic wire, monofilament synthetic line, polyfilament synthetic line, or other flexible materials. In one or more embodiments, the sheet catcher is detachable from the flexible thong and can be replaced after catching a non-dispersible sheet.

Embodiments of the disclosure are vastly easier to use than the stiff strap of the '281 patent. Moreover, the apparatus is far more hygienic for the user. The apparatus has been tested—and can be used—with a variety of toilet types. One or more embodiments are especially useful when used with pressure-jet assist toilets, such as those used in medical and health care service facilities. Embodiments of the disclosure resulted from extensive experimental testing. Many different apparatuses were tested at various commercial and medical locations to demonstrate efficacy working with a variety of toilet models, flush systems, and sizes.

In one embodiment, an apparatus for catching non-dispersible sheets includes a toilet seat engagement portion, a sheet catcher comprising one or more barbs, and a flexible thong coupling the toilet seat engagement portion to the sheet catcher. In one embodiment, the toilet seat engagement portion comprises a retention bar defining one or more receivers to receive retaining bolts of a toilet sat. Accordingly, the retention bar can be placed inconspicuously behind a toilet seat with the flexible thong passing beneath the toilet seat into the bowl. In one embodiment, the toilet seat engagement portion further comprises a thong coupler extending distally from the retention bar between the first receiver and the second receiver. The thong coupler, which is shaped like a frustum in cross-section in one embodiment, acts as a plank extending from the retention bar to extend the coupling point with the flexible thong to or beyond the edge of the toilet bowl rim.

In one embodiment, when the toilet seat engagement portion is coupled to the retaining bolts of a toilet seat, the flexible thong extends into the inner surface of the bowl. The sheet catcher can then be situated within a water seal of the toilet when the toilet seat engagement portion engages the toilet seat. When non-dispersible sheets are flushed, the barbs to catch the sheets while letting dispersible sheets and human waste pass by.

Embodiments of the disclosure are simple and inexpensive to manufacture. In one embodiment, a sheet-catching apparatus comprises one or more slugs having the barbs extending therefrom. The one or more slugs can be manufactured from metal, plastic, or other rigid or semi-rigid materials. In one embodiment, the one or more slugs are manufactured from metal so as to have sufficient weight to withstand, and catch non-dispersible sheets during, powerful flushes through the out-flow channel of a toilet. Where metal is used, it can be coated in plastic, polymers, or other materials so as not to scratch or otherwise damage a toilet bowl.

In one embodiment, the sheet catcher includes a first slug and a second slug. One or more barbs extend from the first slug, while one or more additional barbs extend from the second slug. In one embodiment, each slug is between four and five inches in length. Each barb may extend at an angle from each slug body at a distance of more than three quarters of an inch in one or more embodiments. In one embodiment, four to six barbs extend from each slug. Where two slugs are used, they can be coupled together with a flexible connector. While two slugs are used in one embodiment, other embodiments may use only one slug. Other configurations will be obvious to those of ordinary skill in the art having the benefit of this disclosure. For example, other embodiments may employ three, four, or more slugs. Similarly, each slug can include three or more barbs of eighteen to twenty gauge stainless steel.

When the sheet catcher is placed within the water seal such that it at least partially extends into the trapway, the one or more barbs have been found through experimental testing to catch non-dispersible sheets while allowing other materials to pass. Specifically, when test media, e.g., simulated or actual human feces, and toilet paper were flushed with non-dispersible sheets, the barbs of the sheet catcher caught the sheet while allowing the other materials to pass. The tester was then able to conveniently and quickly remove the non-dispersible sheet to a waste receptacle without touching the toilet or placing their hands beneath the rim of the bowl.

Figure 2:
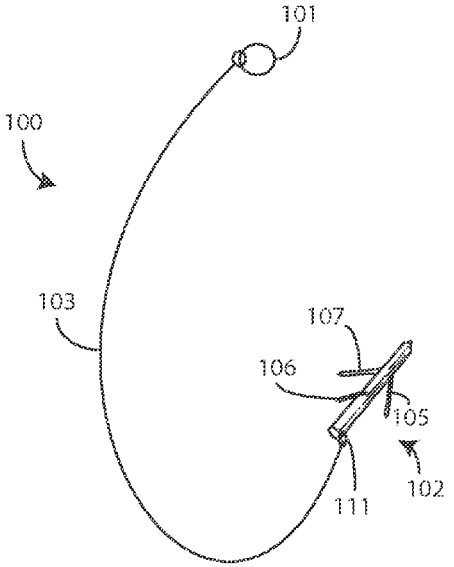
FIG. 2 illustrates another perspective view of one explanatory apparatus in accordance with one or more embodiments of the disclosure.

Turning now to FIGS. 1-2, illustrated therein is one example of an apparatus 100 for catching sheets configured in accordance with one or more embodiments of the disclosure. In one embodiment, the apparatus 100 includes a toilet seat engagement portion 101, a sheet catcher 102, and a flexible thong 103. In this embodiment, the flexible thong 103 couples the toilet seat engagement portion 101 to the sheet catcher 102.

In one embodiment, the sheet catcher 102 is configured as a slug 104 having one or more barbs 105,106,107,108 extending therefrom. In one embodiment, the one or more barbs 105,106,107,108 permit dispersible sheets or human waste to pass when the toilet is flushed while catching non-dispersible sheets.

The number 109 of barbs 105,106,107,108 can vary. In one embodiment, the number 109 of barbs 105,106,107,108 is between four and six. However, other barb quantities will be obvious to those of ordinary skill in the art having the benefit of this disclosure. For example, two or three barbs could be used. Similarly, seven, eight, or more barbs could be used. Experimental testing has shown that between four and six barbs 105,106,107,108 are effective in catching non-dispersible sheets while allowing other materials to pass.

In one or more embodiments, the slug 104 has a length of between four and five inches.

Experimental testing has shown that a length of about 4.11 inches is highly effective in most pressure-jet assist toilets. The term "about" is intended to describe a dimension inclusive of manufacturing tolerances. Accordingly, a dimension of "about 4.11 inches" having a manufacturing tolerance of plus or minus 0.10 inches can be between 4.01 inches and 4.21 inches, inclusive.

In one or more embodiments, the sheet catcher 102 can be coated with a material 112. The material 112 can be plastic, polymer, paint, or other materials. In one embodiment, the sheet catcher 102 can be coated with a material 112 so as not to damage, scratch, or otherwise affect the inside of the bowl of the toilet when in use. For example, in one embodiment the slug 104 is plastic coated such that the barbs 105,106, 107,108 do not chip or scratch the bowl of the toilet.

In one embodiment, the barbs 105,106,107,108 are spaced from each other about an axis 110 of the sheet catcher 102. As shown in FIG. 1, one barb 105 extends from the axis 110 at an angle of about 150 degrees relative to the axis of the sheet catcher 102. In one embodiment, another barb 106 extends along at a similar angle, but is axially distally disposed relative to barb 105. Other barbs can be similarly configured. The axial distance separating the barbs 105,106, 107,108 can be advantageous in that it ensures that at least one barb extend beneath the slug 104 when the sheet catcher 102 is disposed within the water seal of a toilet, thereby serving as a "foot" to raise the sheet catcher 102 slightly off the bottom of a trapway of a toilet. This can lead to a better non-dispersible catch rate according to experimental testing. Note that the embodiment of FIGS. 1-2 is has been shown to be advantageous in experimental testing. However, other barb configurations will be obvious to those of ordinary skill in the art having the benefit of this disclosure.

In one embodiment, the flexible thong 103 is manufactured from a metal or synthetic cable, metal or synthetic wire, monofilament synthetic line, polyfilament synthetic line, or other flexible materials. In one or more embodiments, the sheet catcher 102 is detachable from the flexible thong 103 and can be replaced after catching a non-dispersible sheet. For example, the sheet catcher 102 is shown detached from the flexible thong 103 in FIG. 1, while being shown attached to the flexible thong 103 in FIG. 2. A coupling ring 111 can be used to selectively couple the sheet catcher 102 to the flexible thong 103 by passing through one or more apertures disposed along the slug 104. Other coupling mechanisms will be obvious to those or ordinary art having the benefit of this disclosure.

In one embodiment, the toilet seat engagement portion 101 is configured to couple to either a toilet seat or one or more retaining bolts of the toilet seat. For example, in this embodiment the toilet seat engagement portion 101 is configured as a rigid ring. Accordingly, the flexible thong 103 can be wrapped about either a toilet seat or the one or more retaining bolts of the toilet seat and passed through the toilet seat engagement portion 101 while the sheet catcher 102 is detached to form a slip knot coupling. The sheet catcher 102 can then be attached to the flexible thong 103, as shown in FIG. 2, and placed within the bowl of the toilet. While a rigid ring is one type of toilet seat engagement portion 101 suitable for use with embodiments of the disclosure, others can be used as well. For instance, an alternate toilet seat engagement portion 101 will be shown below with reference to FIGS. 4-5. Still others will be obvious to those of ordinary skill in the art having the benefit of this disclosure.

Figure 3:
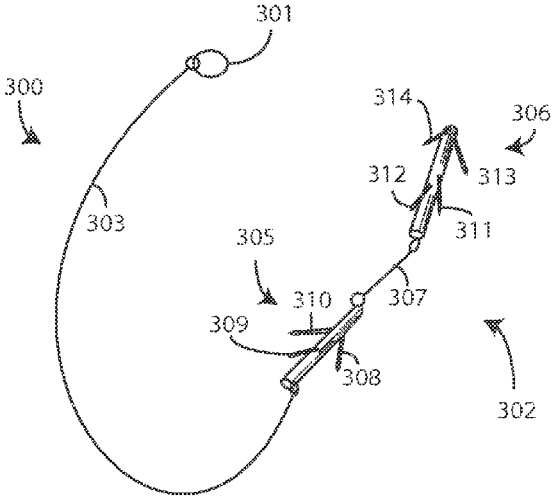
FIG. 3 illustrates a perspective view of another explanatory apparatus in accordance with one or more embodiments of the disclosure.

Turning now to FIG. 3, illustrated therein is another embodiment of an apparatus 300 in accordance with one or more embodiments of the disclosure. As with the embodiment of FIGS. 1-2, the apparatus 300 of FIG. 3 includes a toilet seat engagement portion 301, a sheet catcher 302, and a flexible thong 303. In this embodiment, the flexible thong 303 couples the toilet seat engagement portion 301 to the sheet catcher 302.

In this embodiment, the sheet catcher includes a first slug 305 and a second slug 306. In one embodiment, each of the first slug 305 and the second slug 306 are between four and five inches in length. The first slug 305 and the second slug 306 are tethered together in this embodiment by a flexible connector 307. The flexible connector 307 can be of the same material as the flexible thong 303, or can be a different material. As with the embodiment of FIGS. 1-2, each of the first slug 305 and the second slug 306 can be coated with a material such as plastic, or another material.

Each of the first slug 305 and the second slug 306 can include one or more barbs. For example, the first slug 305 can comprise one or more barbs 308,309,310, while the second slug 306 comprises one or more additional barbs 311,312,313,314. In one embodiment, the first slug 305 and the second slug 306 each comprise between four and six barbs. Each of these barbs can be spaced about an axis of each slug as previously described.

In one embodiment, the first slug 305 is selectively detachable from the flexible thong 303 and the flexible connector 307. Similarly, the second slug 306 can be detachable from the flexible connector 307. Detachability allows a user to remove and/or replace slugs as desired. Detachability also allows the user to discard slugs after catching a non-dispersible sheet. Detachability also allows the user to select whether the sheet catcher 302 uses one slug, two slugs, or more slugs. In other embodiments, the sheet catcher 302 and the flexible thong 303 can be integrated together as a single unit.

Figure 4:
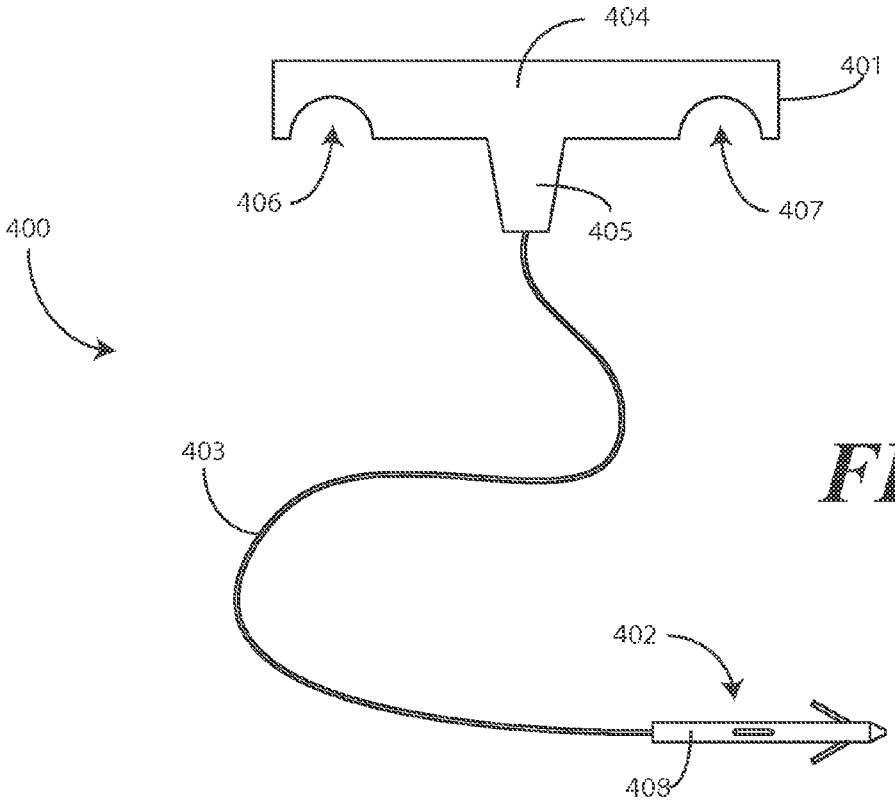
FIG. 4 illustrates a plan view of yet another explanatory apparatus in accordance with one or more embodiments of the disclosure.

Turning now to FIG. 4, illustrated therein is yet another apparatus 400 configured in accordance with one or more embodiments of the disclosure. As with the embodiments of FIGS. 1-3, the apparatus 400 of FIG. 4 includes a toilet seat engagement portion 401, a sheet catcher 402, and a flexible thong 403. In this embodiment, the flexible thong 403 couples the toilet seat engagement portion 401 to the sheet catcher 402. As previously described, the sheet catcher 402 can be selectively detachable from the flexible thong 403 in one or more embodiments.

The toilet seat engagement portion 401 of this embodiment is different from that of the embodiments of FIGS. 1-3. In this embodiment, the toilet seat engagement portion 401 includes a retention bar 404 and an optional thong coupler 405 extending distally from the retention bar 404 and coupled to the flexible thong 403. In this embodiment, the thong coupler 405 defines a frustum in cross section, which is the plan view shown in FIG. 4. In other embodiments, the thong coupler 405 is omitted and the flexible thong 403 couples directly to the retention bar 404.

In this embodiment, the retention bar 404 defines one or more receivers 406,407. In one embodiment, the receivers 406,407 are to receive retaining bolts of a toilet seat. While partially circular in this embodiment, the receivers 406, 407 can take other shapes as well. For example, in another embodiment the receivers 406,407 can be partially hexagonal so as to receive bolt heads. In another embodiment, the receivers 406,407 can be partially ovular, partially square, partially triangular, or take other shapes so as to accommodate fittings disposed about the retaining bolts of a toilet seat. The inclusion of the receivers 406,407 advantageously allows the toilet seat engagement portion 401 to rest unnoticeably beneath a toilet seat with the retention bar 404 disposed behind the retaining bolts. Where included, the thong coupler 405 then extends under the toilet seat to, or beyond, the rim of the toilet to allow the flexible thong 403 to extend into the bowl so that the sheet catcher 402 can extend at least partially into a trapway of a toilet.

Figure 5:
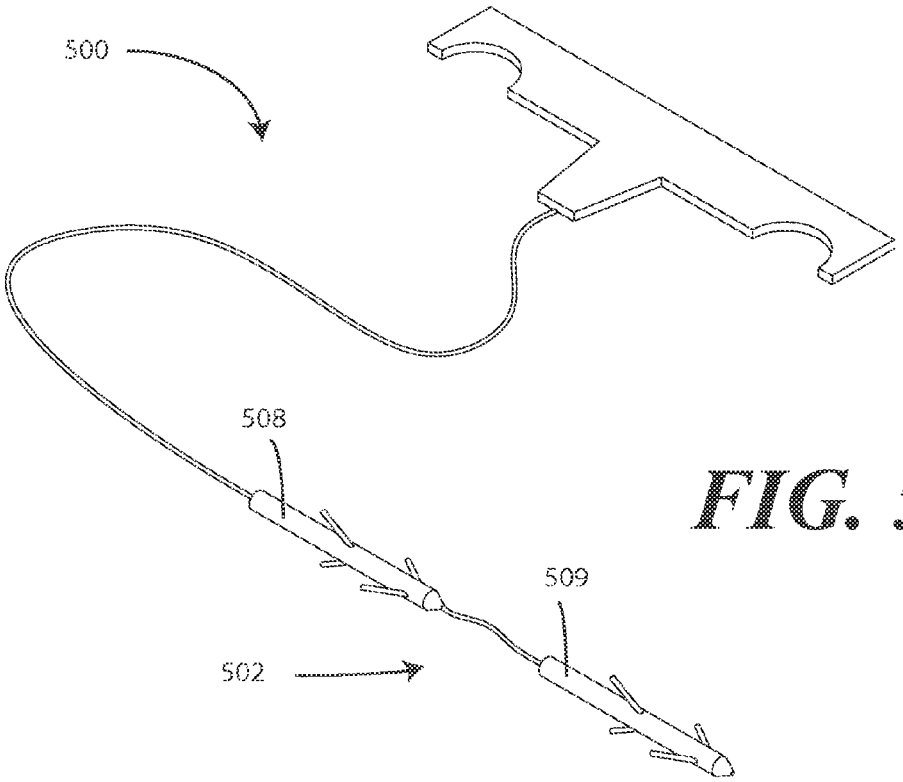
FIG. 5 illustrates a perspective view of still another explanatory apparatus in accordance with one or more embodiments of the disclosure

As shown in FIG. 4, the sheet catcher 402 includes a single slug 408 coupled to the flexible thong 403. However, as noted above, more slugs can be used. As shown in FIG. 5, an alternate sheet catcher 502 of an alternate apparatus 500 can include a first slug 508 and a second slug 509.

It should be noted that there are a variety of ways in which apparatuses configured in accordance with embodiments of the disclosure can be configured. The embodiment of FIGS. 3 and 4 is but one. Others will be obvious to those of ordinary skill in the art having the benefit of this disclosure. Illustrating by example, turning briefly to to FIGS. 17-18, illustrated there are yet other apparatuses configured in accordance with one or more embodiments of the disclosure.

Figure 17:
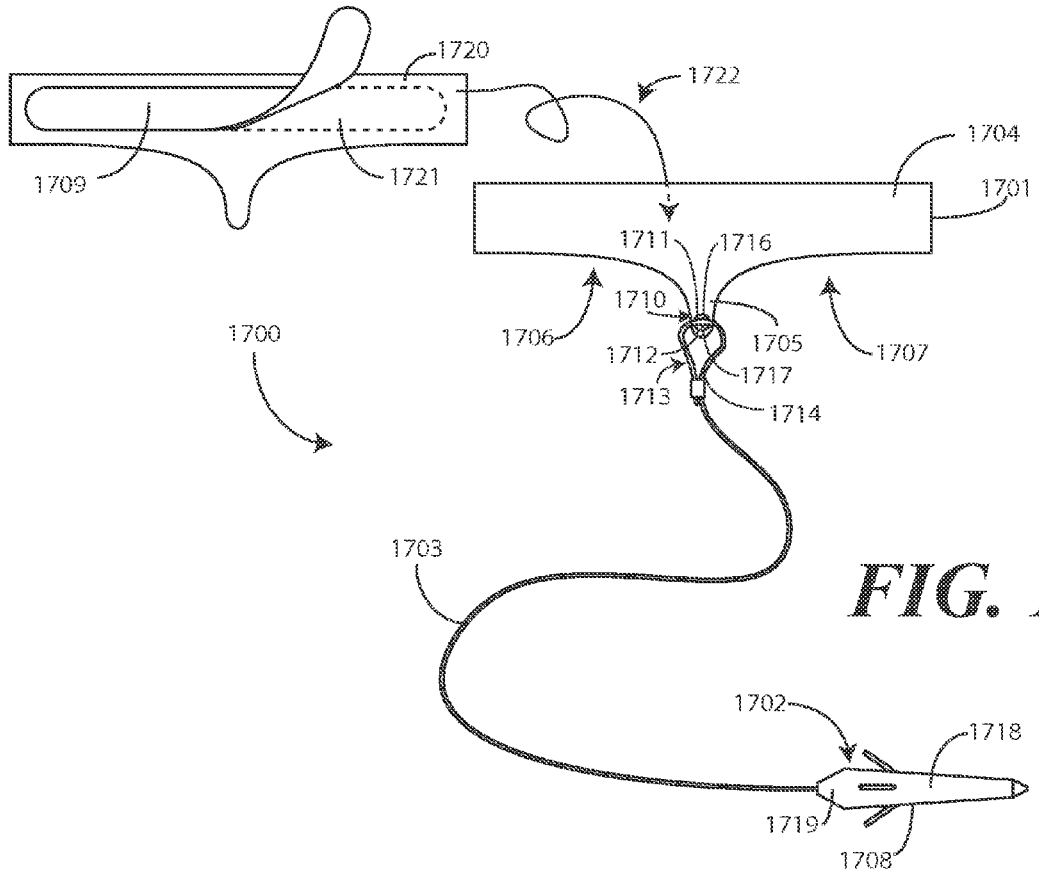
FIG. 17 illustrates an alternate apparatus in accordance with one or more embodiments of the disclosure.
Figure 18:
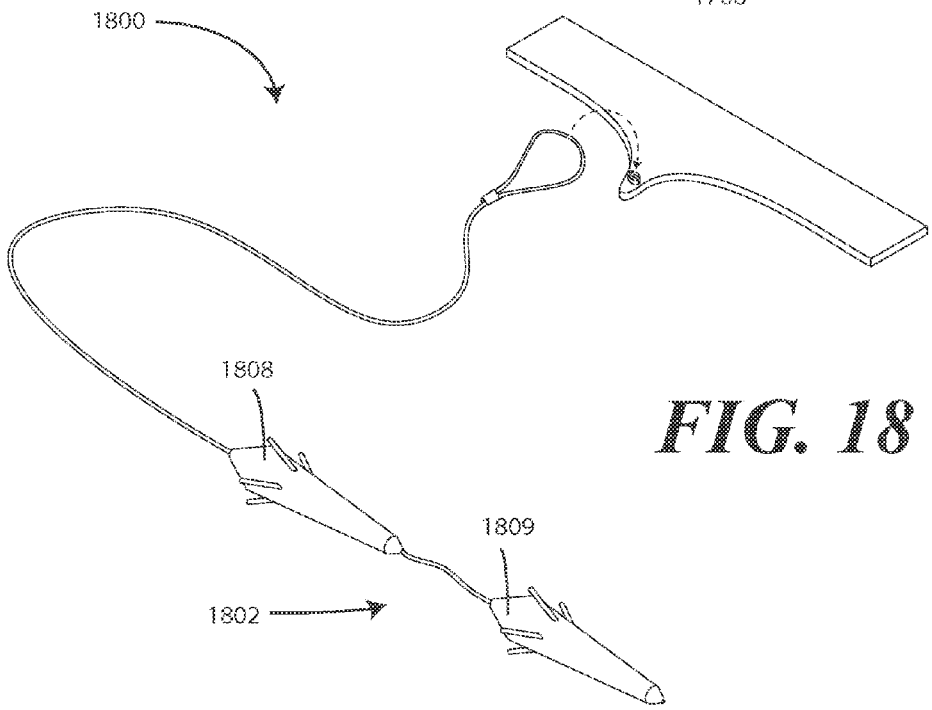
FIG. 18 illustrates another apparatus in accordance with one or more embodiments of the disclosure.

Beginning with FIG. 17, illustrated therein is an apparatus 1700 that, like the embodiments of FIGS. 1-5, includes a toilet seat engagement portion 1701, a sheet catcher 1702, and a flexible thong 1703. The flexible thong 1703 couples the toilet seat engagement portion 1701 to the sheet catcher 1702. As previously described, the sheet catcher 1702 can be selectively detachable from the flexible thong 1703 in one or more embodiments.

In this embodiment, the underside 1720 of the retention bar 1704 has disposed thereon an adhesive 1721. A selectively a peelable cover layer 1709 can be removed from the adhesive 1721, thereby exposing the same. The toilet seat engagement portion 1701 can then be flipped 1722 so that the adhesive 1721 can be pressed against the top surface of a toilet seat rim to further hold the retention bar 1704 in place behind the retaining bolts of a toilet seat. While the inclusion of adhesive 1721 on the underside 1720 is optional, it can be used with any embodiment of the present disclosure.

The toilet seat engagement portion 1701 of this embodiment is different from that of the embodiments of FIGS. 1-5. In this embodiment, the toilet seat engagement portion 1701 includes a retention bar 1704 and a thong coupler 1705 extending distally from the retention bar 1704. Disposed on the thong coupler 1705 is a loop-pinch coupler 1710 having a first half 1711 and a second half 1712. The flexible thong 1703 of this embodiment terminates at a thong coupler attachment portion 1713 configured as a loop 1714.

The thong coupler attachment portion 1713 is configured as two partial circular portions that face each other with flat pinch faces 1716,1717. To attach the flexible thong 1703 to the thong coupler attachment portion 1713, a user simply presses the loop 1714 between the flat pinch faces 1716, 1717 to establish a friction fit. Alternatively, the flat pinch faces can have recesses so that pressing the loop 1714 between the flat pinch faces 1716,1717 can result in a snap fit. The addition of the thong coupler attachment portion 1713 is advantageous in that it allows the user to dispose of the entire flexible thong 1703 and sheet catcher 1702 assembly without touching any portion of the same that has been beneath the waterline of the toilet. In other embodiments, the thong coupler attachment portion 1713 is omitted and the flexible thong 1703 attached directly to the thong coupler 1705.

Figure 19:
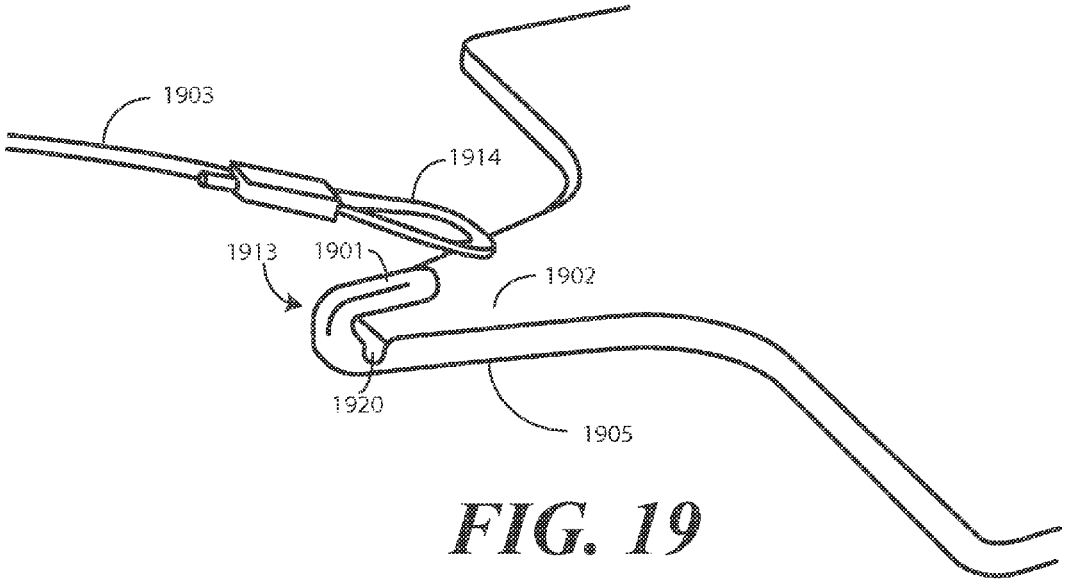
FIG. 19 illustrates another apparatus in accordance with one or more embodiments of the disclosure.

It should be noted that other types of thong coupler attachment portions could be used as well. Turning briefly to FIG. 19, illustrated therein is an alternate thong coupler attachment portion 1913 comprising a hook 1901 and planar receiver 1902. To attach the flexible thong 1903 to the thong coupler attachment portion 1913, a user slides the loop 1914 of the flexible thong 1903 between the hook 1901 and planar receiver 1902 toward an end of the thong coupler 1905. In one embodiment, the loop 1914 then seats within a receiving groove 1920 at the base of the thong coupler 1905.

Turning now back to FIG. 17, another difference in this embodiment compared to others previously described is that of the shape of the thong coupler 1705. Rather than defining a frustum in cross section, as was shown in FIG. 4, here there is a continuous, concave curvature extending from edges of the retention bar 1704 and terminating at a tip of the thong coupler to define smoothly concave receivers 1706,1707 to bias against the retaining bolts of a toilet seat. As with previous embodiments, the inclusion of the receivers 1706, 1707 advantageously allows the toilet seat engagement portion 1701 to rest unnoticeably beneath a toilet seat with the retention bar 1704 disposed behind the retaining bolts. In one or more embodiments, the thong coupler 1705 then extends under the toilet seat to, or beyond, the rim of the toilet to allow the flexible thong 1703 to extend into the bowl so that the sheet catcher 1702 can extend at least partially into a trapway of a toilet.

As shown in FIG. 17, the sheet catcher 1702 includes a single slug 1708 coupled to the flexible thong 1703. Note that the body of the single slug 1708 has a different shape from previous embodiments. Here, the single slug 1708 has a double-cylindrical pyramidal shape, with a first, longer cylindrical pyramidal shape 1718 extending from the base of a second, shorter cylindrical pyramidal shape 1719. While a single slug is shown in FIG. 17, more slugs can be used. As shown in FIG. 18, an alternate sheet catcher 1802 of an alternate apparatus 1800 can include a first slug 1808 and a second slug 1809.

Figure 20:
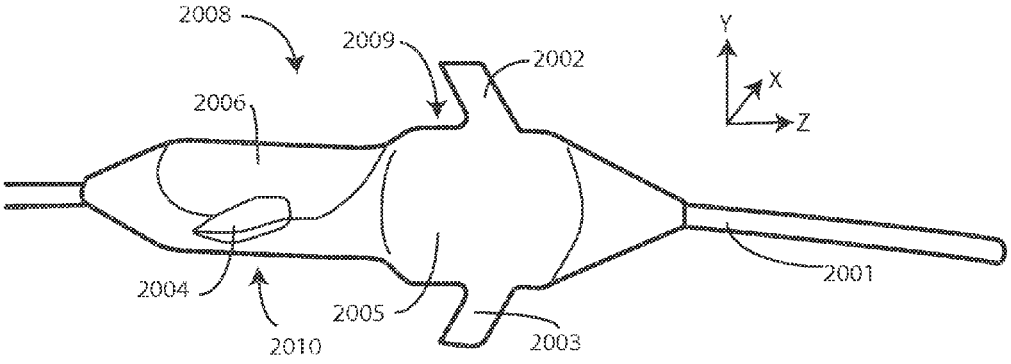
FIG. 20 illustrates another apparatus in accordance with one or more embodiments of the disclosure.

It should be noted that the slug can be configured in other ways as well. Turning briefly to FIG. 20, illustrated therein is a single slug 2008 that has been injection molded about a continuous monofilament 2001. This slug 2008 includes four barbs 2002,2003,2004. Three barbs 2002,2003,2004 are shown—a complementary barb to barb 2004 extends into the page. This slug 2008 also includes two pinched surface 2005,2006 that are rotated out of phase relative to each other by ninety-degrees about an axis defined by the continuous monofilament 2001. This "double pinched" design results in a first half 2009 of the single slug 2008 being thicker along the Y-axis and thinner along the X-axis, while a second half 2010 of the single slug is the opposite, namely, thicker along the X-axis and thinner along the Y-axis. In this illustrative embodiment, the barbs 2002,2003,2004 extend from the thicker portions. Accordingly, barbs 2002,2003 extend along the Y-axis from the first half 2009 of the single slug 2008, while barb 2004 and its complementary barb (not shown) extend along the X-axis. Experimental testing has shown this design to be easy to manufacture, inexpensive, and highly effective at catching sheets.

Figure 6:
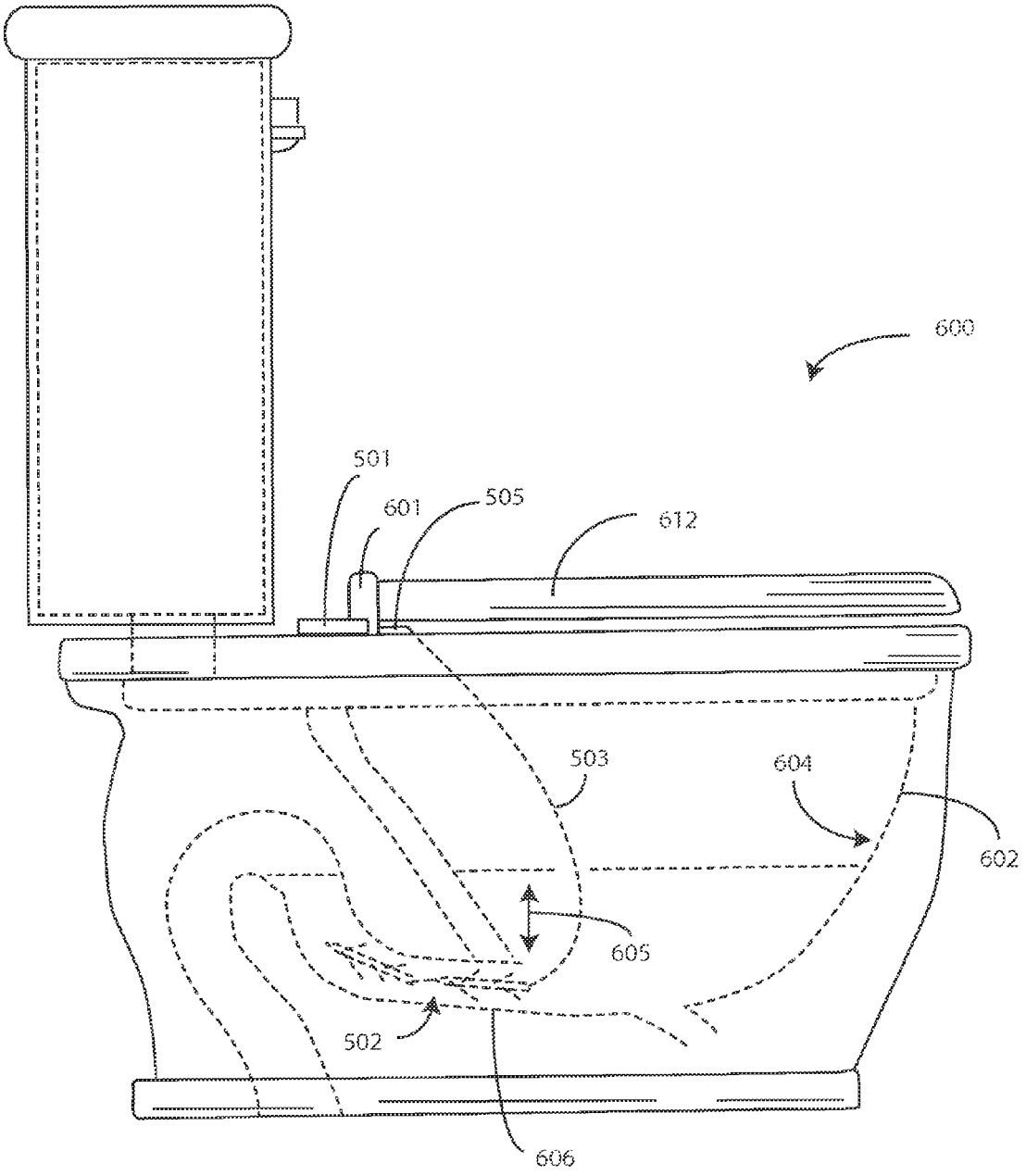
FIG. 6 illustrates one explanatory apparatus in accordance with one or more embodiments of the disclosure attached to a first type of toilet.

Turning now to back to FIG. 6, illustrated therein is the apparatus 500 of FIG. 5 coupled to a pressure-jet assist toilet 600. While the apparatus 500 from FIG. 5 was selected to illustrate the operation of one or more embodiments of the invention, other embodiments such as those shown in FIGS. 1-4 could have been selected as well.

As shown in FIG. 6, the toilet seat engagement portion 501 has been placed behind the retention bolts 601 of a toilet seat 612. The thong coupler 505 extends beneath the toilet seat 612 from the retention bar of the toilet seat engagement portion 501 and connects to the flexible thong 503. A user can easily place the apparatus (500) in this position by selectively detaching the sheet catcher 502 from the flexible thong 503 in one embodiment. If the sheet catcher 502 is integrally formed with the flexible thong 503, the user can still easily place the apparatus (500) in this position by pivoting the toilet seat engagement portion 501 such that the length of the retention bar passes through the retention bolts 601. The toilet seat engagement portion 501 can then be pivoted in the reverse direction so that the retention bolts 601 of the toilet seat 612 are engaged in the one or more receivers of the retention bar.

In one embodiment, the flexible thong 503 then passes along an inner contour 604 of the bowl 602. The sheet catcher 502 is disposed within the water seal 605 of the pressure-jet assist toilet 600 in this embodiment when the toilet seat engagement portion 501 engages the toilet seat. In this illustrative embodiment, the sheet catcher 502 at least partially extends into the trapway 606 of the pressure-jet assist toilet 600. The one or more barbs of the sheet catcher 502 are to catch non-dispersible sheets when the pressure-jet assist toilet 600 is flushed.

Figure 7:
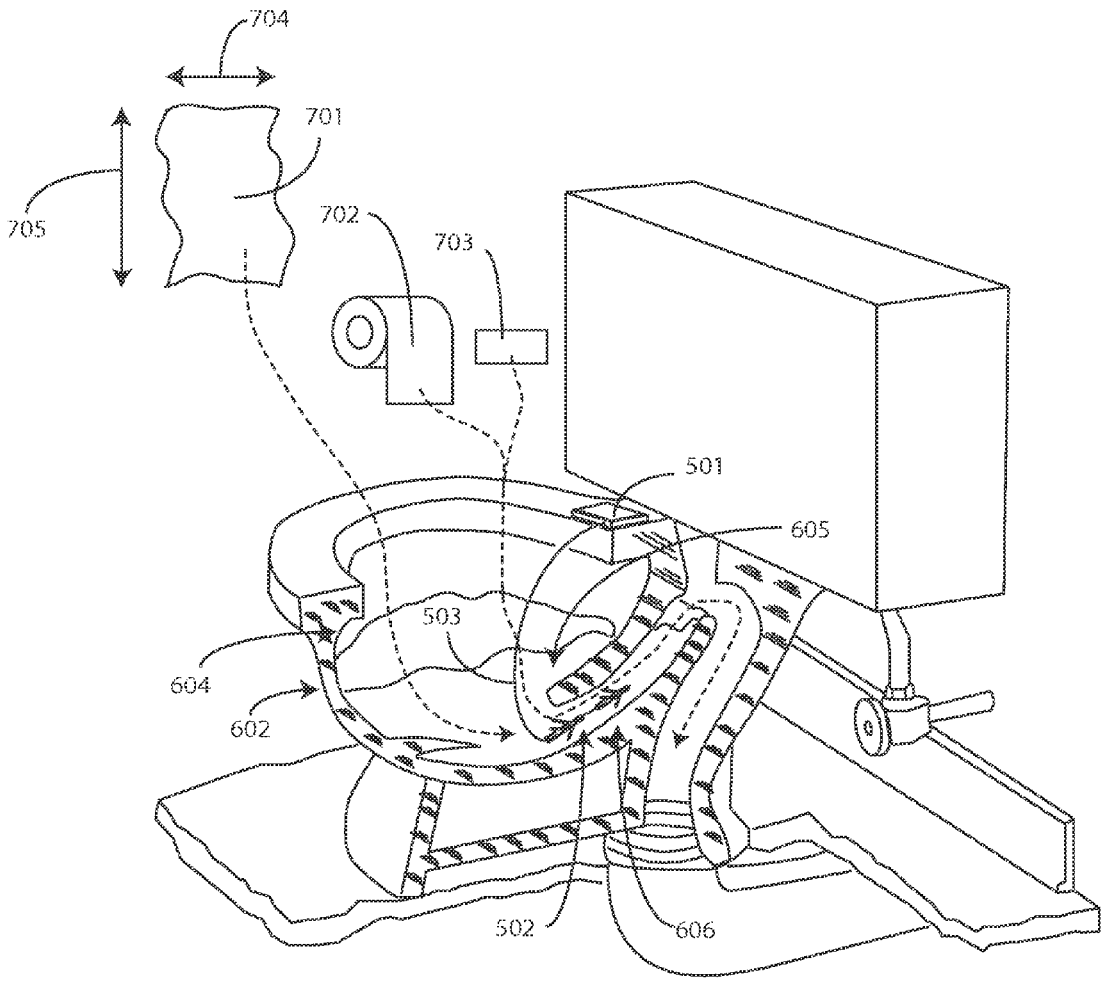
FIG. 7 illustrates one explanatory apparatus in accordance with one or more embodiments of the disclosure attached to the first type of toilet.

Turning to FIG. 7, the assembly of FIG. 6 is shown with the pressure-jet assist toilet 600 in a cut-away view. The toilet seat engagement portion 501 is attached to the seat of the pressure-jet assist toilet 600, and the flexible thong 503 passes along an inner contour 604 of the bowl 602. The sheet catcher 502 is disposed within the water seal 605 of the pressure-jet assist toilet 600, and the sheet catcher 502 at least partially extends into the trapway 606 of the pressure-jet assist toilet 600.

In this configuration, the sheet catcher 502 is configured to catch non-dispersible sheets 701 when the pressure-jet assist toilet 600 is flushed. Examples of non-dispersible sheets 701 include needlepunched and spunlace sheets. Examples of such sheets are marketed by Medline Industries under the names ReadyBath.sup.™ and AloeTouch.sup.™. These non-dispersible sheets 701 can be configured as soft, single patient use, spunlace or needlepunched wipes that are quite gentle on the skin. Such non-dispersible sheets 701 are versatile and convenient for use as wipes for everyday cleaning and incontinence care. In one or more embodiments, the non-dispersible sheets 701 are pre-moistened with rinse-free formula that cleans, moisturizes and soothes the skin. In one or more embodiments, the non-dispersible sheets can be pH-balanced for patient use, can be hypoallergenic, and alcohol free. In one or more embodiments, the non-dispersible sheets 701 can be provided with a light, gender-neutral scent or, alternatively, free of fragrance.

In one or more embodiments, the sheet catcher 502 catches the non-dispersible sheets 701, but allows other materials to pass. For example, in one embodiment, the barbs of the sheet catcher 502 permit paper sheets 702 or other dispersible sheets to pass when the pressure-jet assist toilet 600 is flushed. In one embodiment, the barbs of the sheet catcher 502 also allow human waste 703 to pass when the pressure-jet assist toilet 600 is flushed, as shown. As noted above, this was confirmed when the sheet catcher 502 was tested during the experimental testing sessions.

The sheet catcher 502 of this embodiment has been shown to be well suited to work with non-dispersible sheets having different dimensions. For example, in one embodiment, the non-dispersible sheets 701 have a width 704 of between five and eight inches. In one embodiment, the non-dispersible sheets 701 have a length 705 of between seven and twelve inches. Examples of sizes of the non-dispersible sheets 701 include 5.5"×7.25", 8"×8", and 8"×12". These dimension examples are illustrative only, as others will be obvious to those of ordinary skill in the art having the benefit of this disclosure.

Apparatuses in accordance with embodiments of the disclosure provide a unique device to catch any non-dispersible sheets 701 that may enter a drain or septic system via toilet flushing. As noted above, an apparatus in accordance with one or more embodiments of the disclosure can be used to allow toilet paper and human waste to pass through the sheet catcher 502 while preventing non-dispersible sheets 701 from passage. Embodiments of the disclosure advantageously allow a user to extract the entire unit from the pressure-jet assist toilet 600 to remove the non-dispersible sheet 701 by pulling out the flexible thong 503 without reaching into the bowl 602. This reduces the risk of user contact with the sheet catcher 502 or the barbs, which is a problem with prior art designs.

Figure 8:
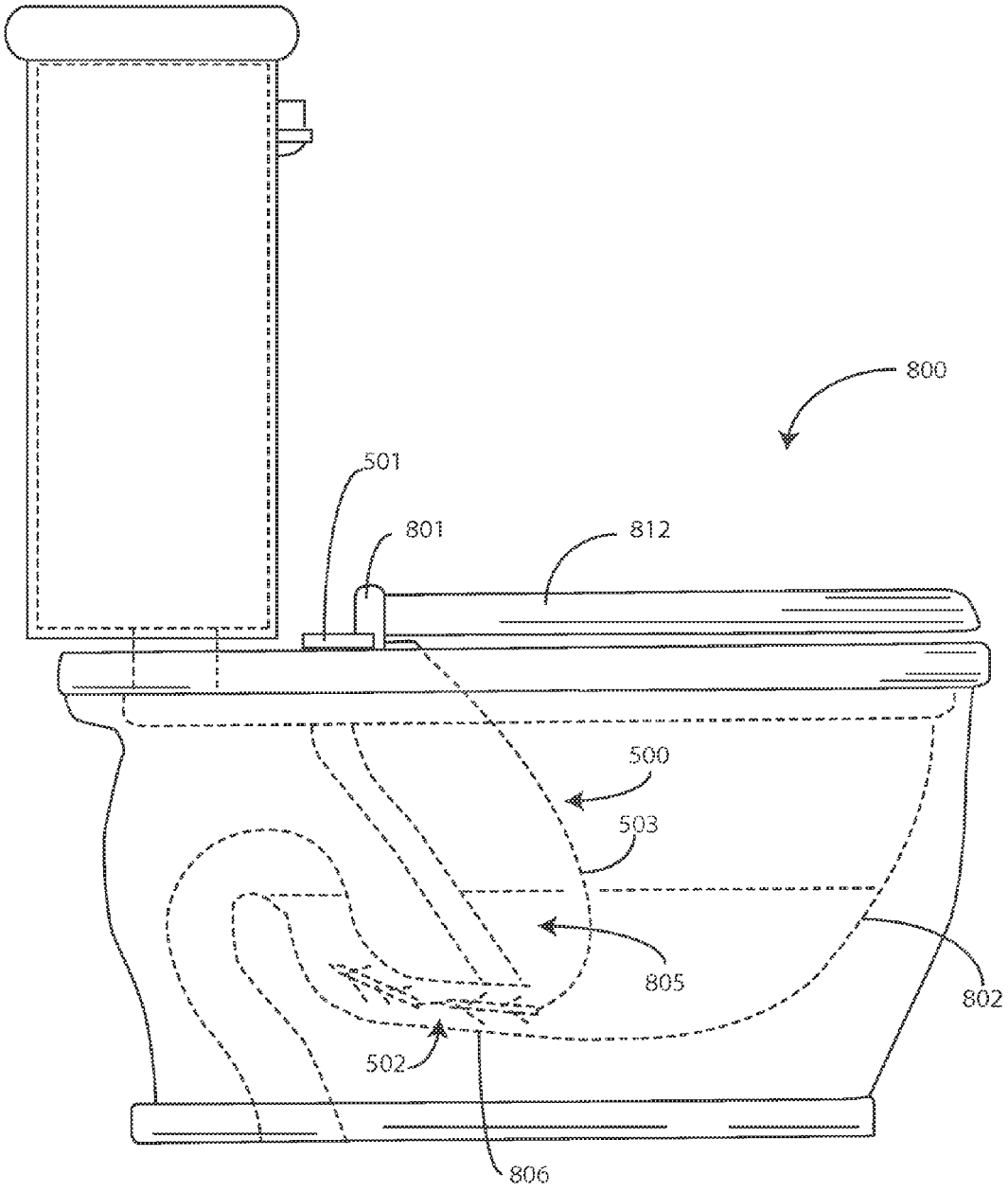
FIG. 8 illustrates one explanatory apparatus in accordance with one or more embodiments of the disclosure attached to a second type of toilet.

Turning now to FIG. 8, illustrated therein is the apparatus 500 coupled to a conventional toilet 800. The toilet seat engagement portion 501 is attached to the retention bolts 801 of the toilet seat 812 of the conventional toilet 800. The flexible thong 503 passes into the bowl 802. The sheet catcher 502 is disposed within the water seal 805 of the conventional toilet 800. In this illustrative embodiment, the sheet catcher 502 at least partially extends into the trapway 806 of the conventional toilet 800.

Figure 9:
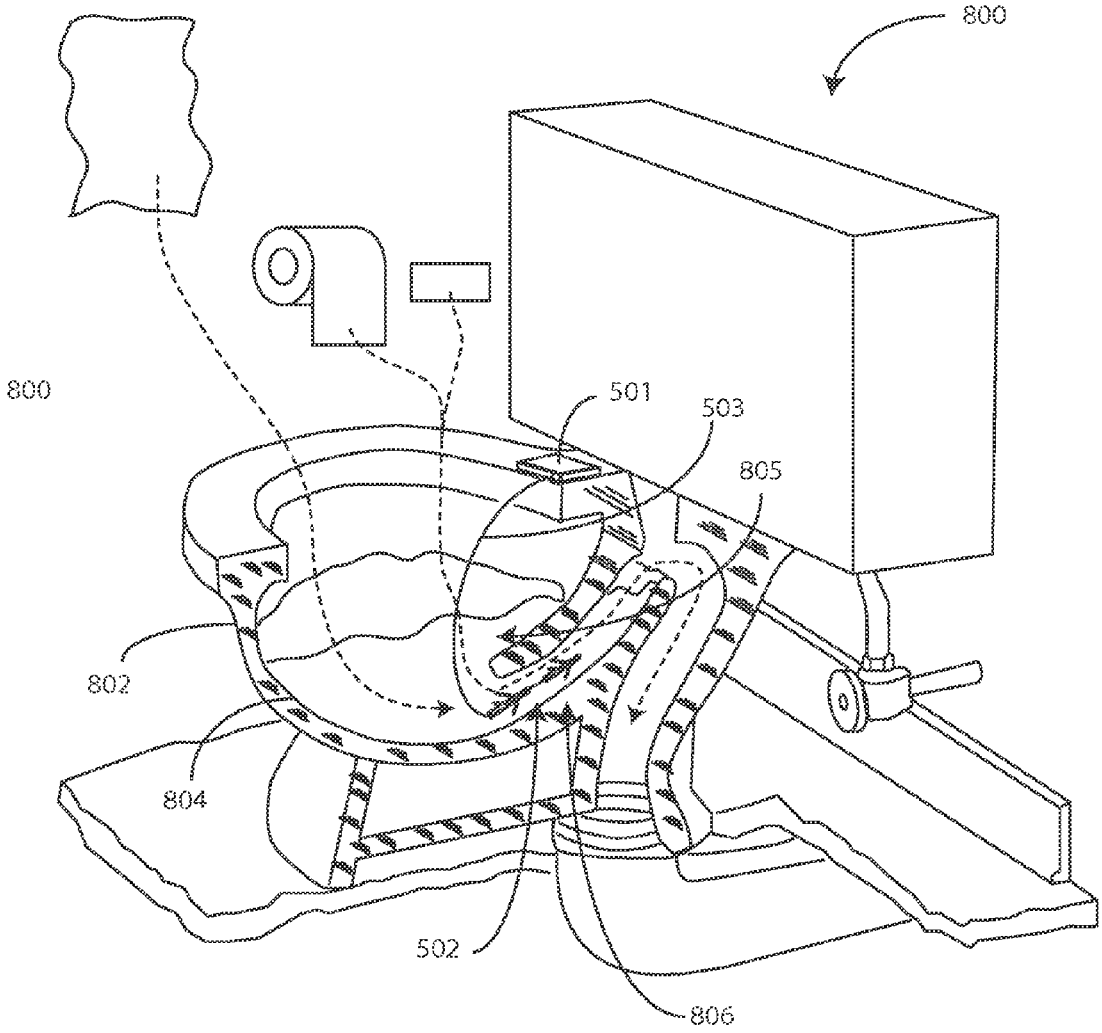
FIG. 9 illustrates one explanatory apparatus in accordance with one or more embodiments of the disclosure attached to the second type of toilet.

Turning to FIG. 9, the assembly of FIG. 8 is shown with the conventional toilet 800 in a cut-away view. The toilet seat engagement portion 501 is attached to the retention bolts of the conventional toilet 800, and the flexible thong 503 passes along an inner contour 804 of the bowl 802. The sheet catcher 502 is disposed within the water seal 805 of the conventional toilet 800, and the sheet catcher 502 at least partially extends into the trapway 806 of the conventional toilet 800. In this configuration, the sheet catcher 502 is configured to catch non-dispersible sheets 901 when the conventional toilet 800 is flushed.

Figure 10:
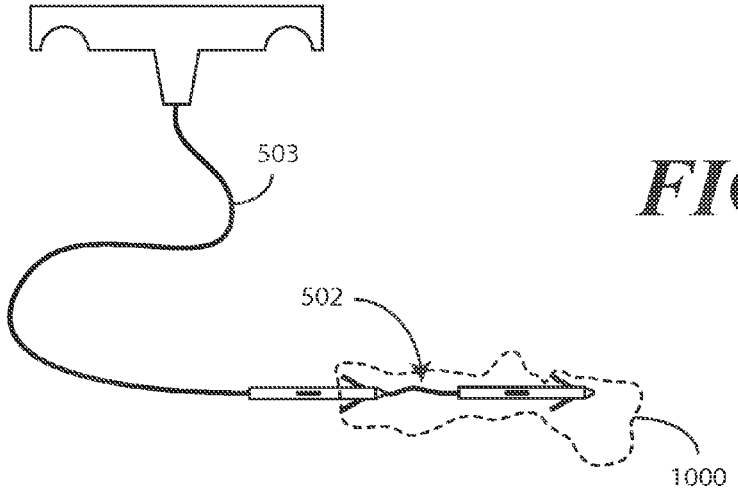
FIG. 10 illustrates one explanatory apparatus in accordance with one or more embodiments of the disclosure after having caught a non-dispersible sheet.
Figure 11:
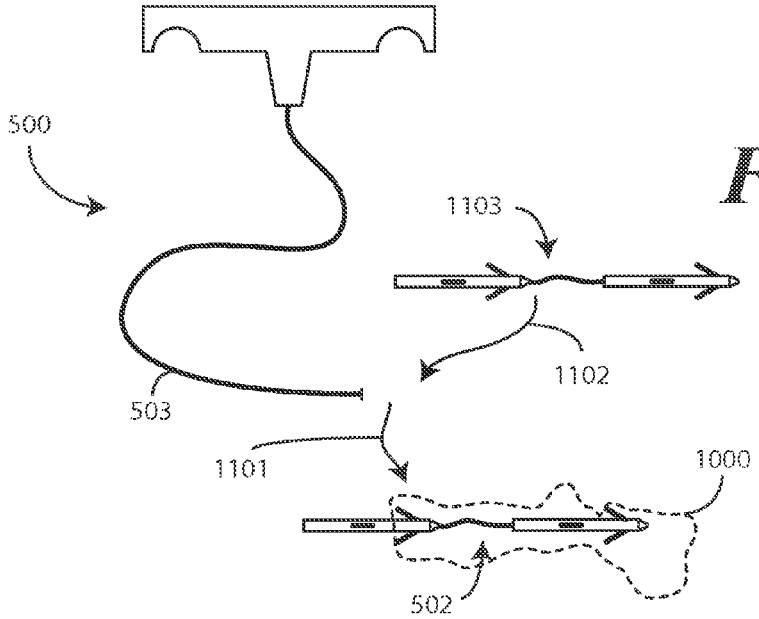
FIG. 11 illustrates method steps of swapping one or more slugs from an explanatory apparatus in accordance with one or more embodiments of the disclosure.
Figure 12:
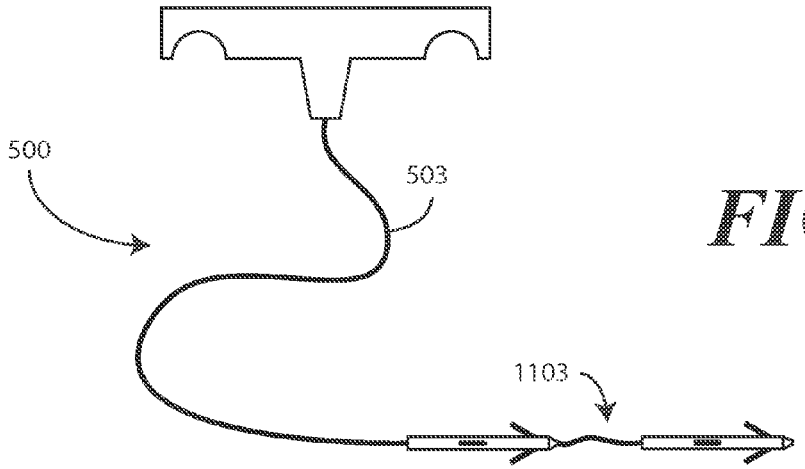
FIG. 12 illustrates the result of the method steps of FIG. 11.

In one or more embodiments, the optional selective detachability of the sheet catcher 502 from the flexible thong 503 advantageously allows the sheet catcher 502 to be replaced when a non-dispersible sheet is caught. This prevents the necessity of the user detangling the caught non-dispersible sheet from the barbs of the sheet catcher 502. Turning now to FIGS. 10-12, this method is shown.

Beginning with FIG. 10, the sheet catcher 502 has caught a non-dispersible sheet 1000. The user can retrieve the non-dispersible sheet 1000 by pulling the flexible thong 503 out of the bowl. In many instances, the user will neither want to attempt to dislodge the non-dispersible sheet 1000 from the barbs nor manipulate the sheet catcher 502 once the non-dispersible sheet is removed. Accordingly, in one or more embodiments the user is simply able to replace the sheet catcher 502 with a new sheet catcher.

As shown in FIG. 11, the user has detached 1101 the previous sheet catcher 502 and non-dispersible sheet 1000 from the flexible thong 503. The user can then attach 1102 a replacement sheet catcher 1103 to the flexible thong 503 to return the apparatus 500 to service. The apparatus 500 with the replacement sheet catcher 1103 attached to the flexible thong 503 is shown in FIG. 12.

Thus, as shown in FIGS. 10-12, the sheet catcher 502 can be easily removed after a non-dispersible sheet 1000 is caught and placed appropriately into the garbage. Another replacement sheet catcher 1103 can then be attached to the flexible thong 503 and the apparatus 500 is ready to catch another non-dispersible sheet (not shown).

Figure 13:
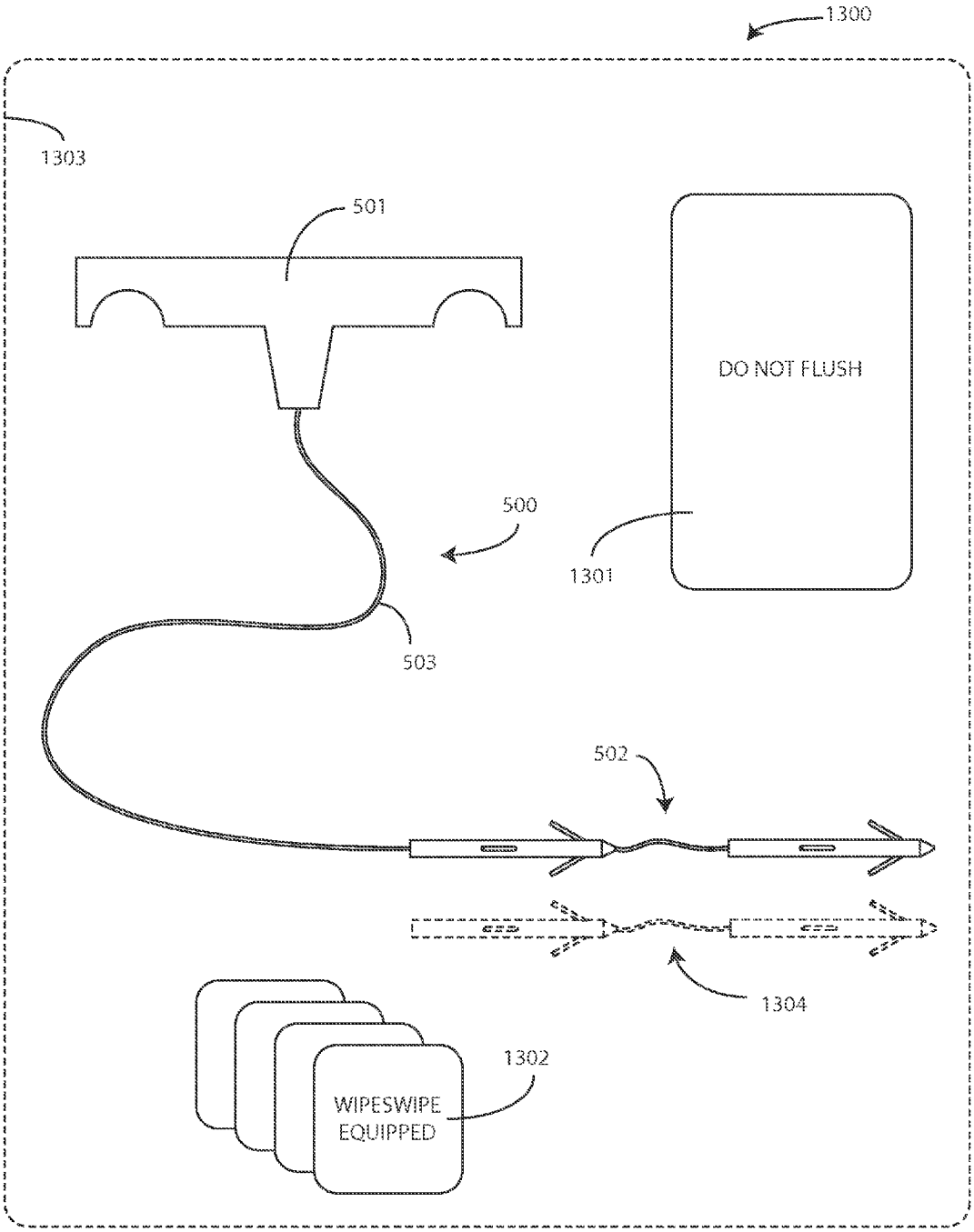
FIG. 13 illustrates an explanatory system in accordance with one or more embodiments of the disclosure.

Embodiments of the disclosure contemplate that it can be advantageous to notify proximate users that a toilet is equipped with the apparatus 500. Accordingly, in one or more embodiments educational materials such as "do-not-flush non-dispersible sheets" and "toilet equipped with an apparatus in accordance with one or more embodiments of the disclosure" can be distributed with the apparatus 500 to encourage safe flushing practices. Turning now to FIG. 13, illustrated therein is one such system 1300.

As shown in FIG. 13, in one embodiment the system 1300 comprises an apparatus 500 for a toilet and one or more of signs 1301 or stickers 1302 that are packaged 1303 with the apparatus 500. In on embodiment, the apparatus 500 includes a toilet seat engagement portion 501, a sheet catcher 502 comprising one or more barbs, and a flexible thong 503 coupling the toilet seat engagement portion 501 to the sheet catcher 502. One or more replacement sheet catchers 1304 can be optionally included with the packaging 1303 of the system 1300 as well. As previously described, the sheet catcher 502 is to situate within a water seal of the toilet when the toilet seat engagement portion engages a toilet seat. The one or more barbs catch non-dispersible sheets when the toilet is flushed.

In one embodiment, the one or more of signs 1301 or stickers 1302 packaged with the apparatus 500 can serve as educational materials corresponding to the apparatus 500. For example, the signs 1301 ma comprising instructions instructing a non-dispersible sheet in the toilet. While the sheet catcher 502 is designed to catch such non-dispersible sheets, an ounce of prevention is worth a pound of cure, and preventing non-dispersible sheets from being flushed in the first place is always the best option. In one embodiment, the stickers 1302 are to attach to a toilet using the apparatus. The stickers 1302 can include, in one embodiment, a notice that the toilet is equipped with the apparatus. Other signs 1301 and stickers 1302 will be obvious to those of ordinary skill in the art having the benefit of this disclosure.

Figure 14:
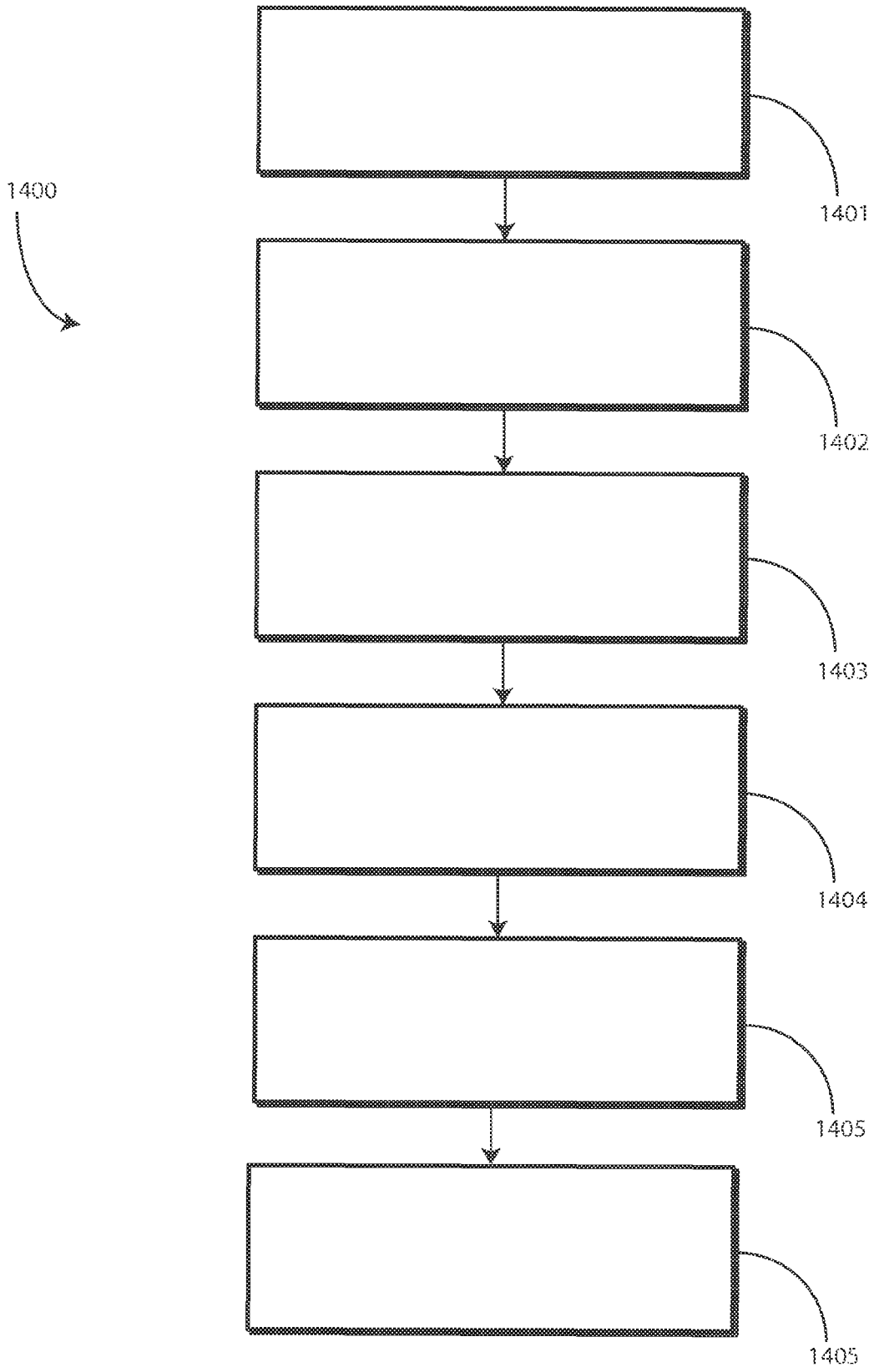
FIG. 14 illustrates an explanatory method in accordance with one or more embodiments of the disclosure.

Turning now to FIG. 14, illustrated therein is one explanatory method 1400 of using an apparatus configured in accordance with one or more embodiments of the disclosure. At step 1401, the user attaches a toilet seat engagement portion to the seat of the toilet. At step 1402, the user places a flexible thong against the inner surface of a bowl of the toilet. At step 1403, a user disposed a sheet catcher in a water seal of a toilet.

At step 1404, non-dispersible sheets are caught with one or more barbs of the sheet catcher when the toilet is flushed. At step 1404 the method 1400 can include allowing one or more of human waste, dispersible product, paper sheets, or combinations thereof, to pass the barbs of the sheet catcher. At step 1405, the user may detach the sheet catcher from a flexible thong and can discard the caught sheet. At step 1406, the user may optionally attach a replacement sheet catcher to the flexible thong to begin the method anew.

Figure 15:
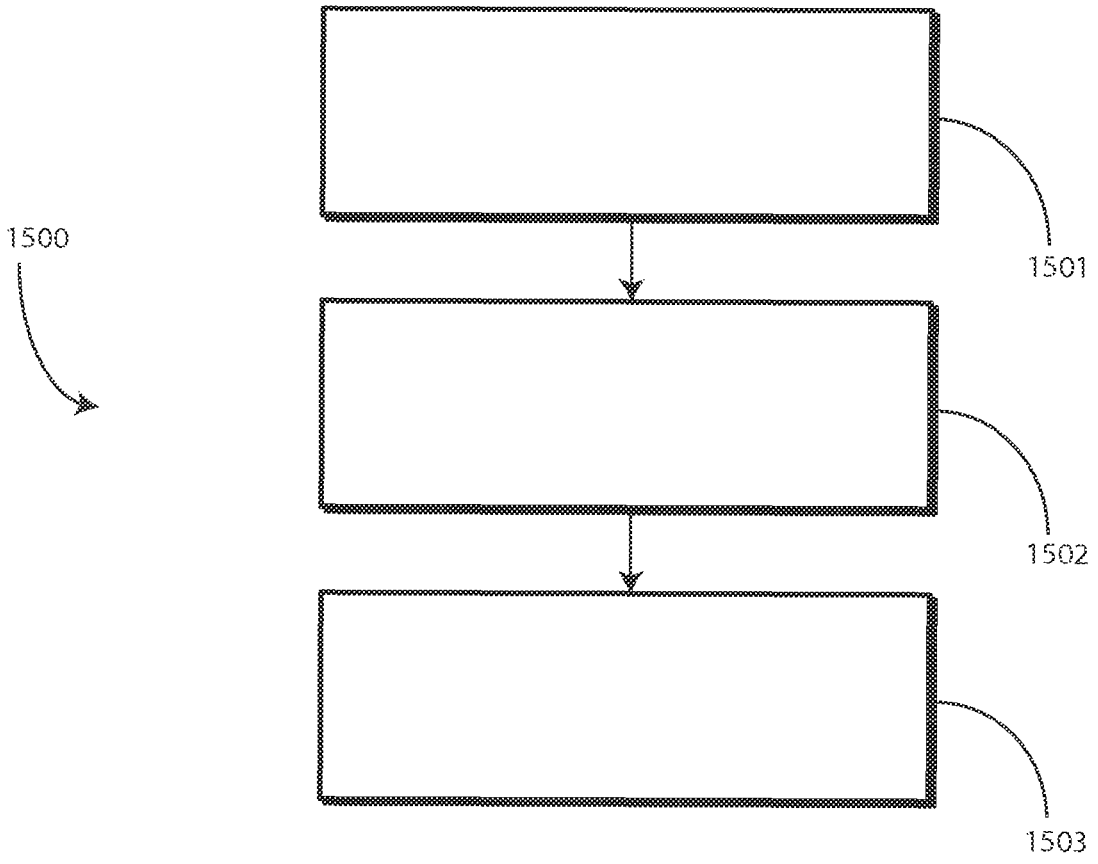
FIG. 15 illustrates an explanatory method in accordance with one or more embodiments of the disclosure.

Turning now to FIG. 15, illustrated therein is a method 1500 of manufacturing an apparatus in accordance with one or more embodiments of the disclosure. At step 1501, the method 1500 includes applying one or more barbs to a sheet catcher. At step 1502, the method can include forming a flexible thong that extends from the sheet catcher. At step 1503, the method 1500 can include further forming a toilet seat engagement portion extending from the flexible thong.

Figure 16:
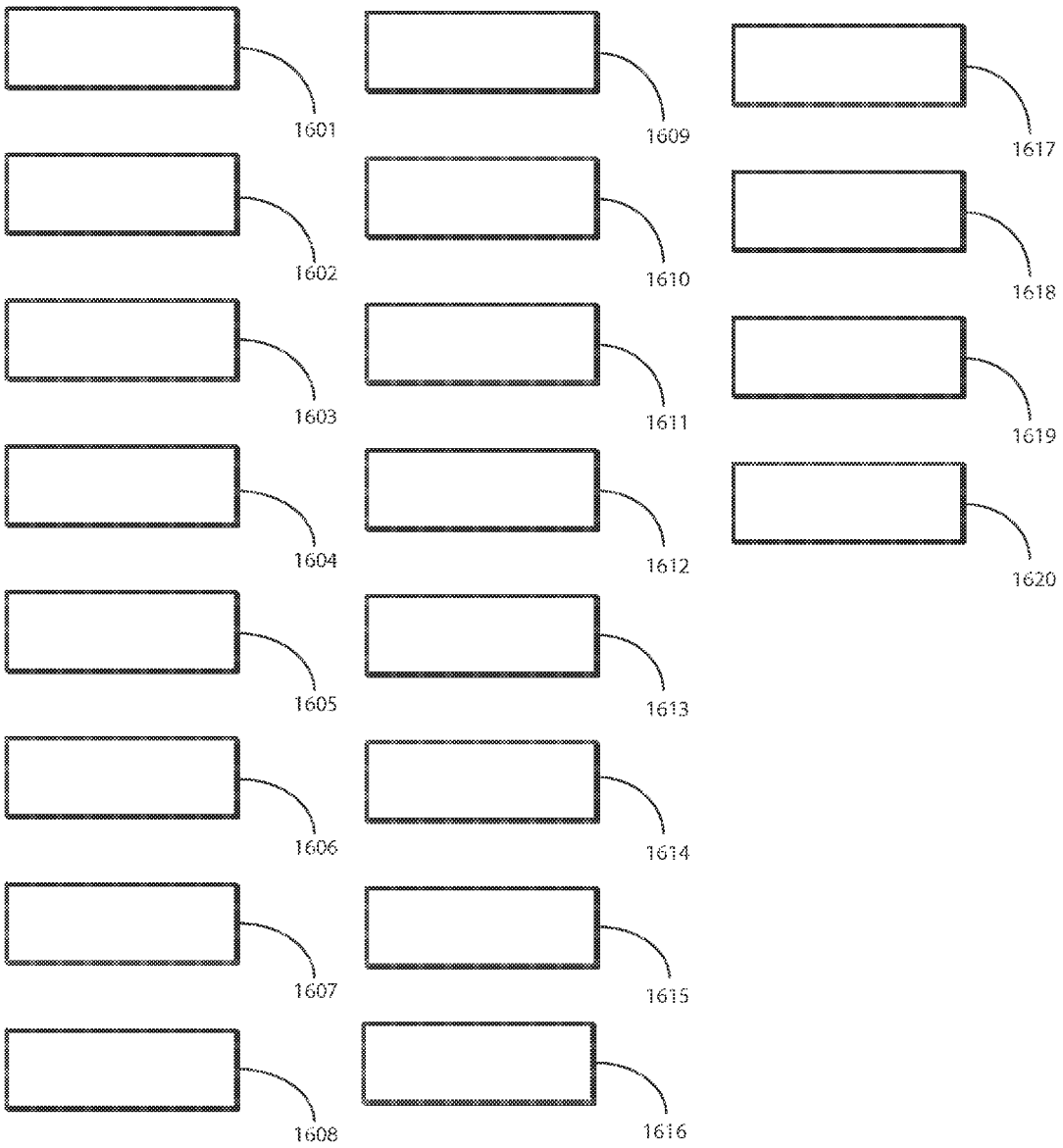
FIG. 16 illustrates various embodiments of the disclosure.

Turning now to FIG. 16, illustrated therein are various embodiments of the disclosure. At 1601, an apparatus for a toilet includes a toilet seat engagement portion, a sheet catcher comprising one or more barbs, and a flexible thong coupling the toilet seat engagement portion to the sheet catcher. At 1601, in one embodiment, the sheet catcher is to situate within a water seal of the toilet when the toilet seat engagement portion engages a toilet seat. At 1601, the one or more barbs are to catch non-dispersible sheets when the toilet is flushed.

At 1602, the sheet catcher of 1601 is to at least partially extend into a trapway of the toilet. At 1603, the sheet catcher of 1602 includes a first slug comprising the one or more barbs and a second slug comprising one or more additional barbs. At 1604, the first slug of 1603 is tethered to the second slug by a flexible connector. At 1605, each of the first slug and the second slug of 1603 are between four and five inches in length. At 1606, each of the first slug and the second slug of 1603 are plastic coated.

At 1607, the sheet catcher of 1601 is selectively detachable from the flexible thong. At 1608, the one or more barbs of 1601 comprise between four and six barbs. At 1609, the one or more barbs 1601 are spaced from each other about an axis of the sheet catcher.

At 1610, the toilet seat engagement portion of 1601 comprises a retention bar defining one or more receivers to receive retaining bolts of the toilet seat. At 1611, the toilet seat engagement portion of 1610 further comprises a thong coupler extending distally from the retention bar between a first receiver and a second receiver. At 1612, the thong coupler of 1611 defines a frustum in cross-section.

At 1613, the one or more barbs of 1601 to permit dispersible sheets or human waste to pass when the toilet is flushed. At 1614, the non-dispersible sheets of 1601 are manufactured from one of needlepunched material or spunlace material.

At 1615, a system includes an apparatus for a toilet comprising a toilet seat engagement portion, a sheet catcher comprising one or more barbs, and a flexible thong coupling the toilet seat engagement portion to the sheet catcher. At 1615, the sheet catcher is to situate within a water seal of the toilet when the toilet seat engagement portion engages a toilet seat and the one or more barbs are to catch non-dispersible sheets when the toilet is flushed.

At 1615, one or more of signs or stickers are packaged with the apparatus. At 1616, the one or more of signs or stickers comprise signs instructing a user not to flush the non-dispersible sheets. At 1617, the one or more of signs or stickers from 1615 comprise one or more stickers to attach to the toilet, the one or more stickers comprising a notice that the toilet is equipped with the apparatus.

At 1618, a method comprises disposing a sheet catcher in a water seal of a toilet, attaching a toilet seat engagement portion to a toilet seat of the toilet, and catching non-dispersible sheets with one or more barbs of the sheet catcher when the toilet is flushed. At 1619, the method of 1618 further comprises permitting one or more of human waste or dispersible sheets to pass when the toilet is flushed. At 1620, the method of 1618 further comprises replacing the sheet catcher after it catches a non-dispersible sheet.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. For example, when installing the apparatus, the user does not need to contact the water in the bowl. When an errant non-dispersible sheet is caught, anyone can easily and safely grip the flexible thong, lift the apparatus with captured cloth out of the toilet and throw it away. Apparatuses configured in accordance with embodiments of the disclosure could further be configured to be reusable or single use (disposable).

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims of this application and all equivalents thereof.

What is claimed is:

1. An apparatus for a toilet, comprising:
- a toilet seat engagement portion;
- a sheet catcher comprising three or more barbs; and
- a flexible thong coupling the toilet seat engagement portion to the sheet catcher;
- the sheet catcher to situate within a water seal of the toilet when the toilet seat engagement portion engages a toilet seat; and
- the three or more barbs spaced from each other about an axis of the sheet catcher to catch non-dispersible sheets when the toilet is flushed.

2. The apparatus of claim 1, the sheet catcher to at least partially extend into a trapway of the toilet.

3. The apparatus of claim 2, the sheet catcher comprising a first slug comprising the three or more barbs and a second slug comprising one or more additional barbs.

4. The apparatus of claim 3, the first slug tethered to the second slug by a flexible connector.

5. The apparatus of claim 4, each of the first slug and the second slug between four and five inches in length.

6. The apparatus of claim 4, each of the first slug and the second slug plastic coated.

7. The apparatus of claim 1, the sheet catcher selectively detachable from the flexible thong.

8. The apparatus of claim 1, the three or more barbs comprising between four and six barbs.

9. The apparatus of claim 1, the three or more barbs extending distally from a slug.

10. The apparatus if claim 1, the toilet seat engagement portion comprising a retention bar defining one or more receivers to receive retaining bolts of the toilet seat.

11. The apparatus of claim 10, the toilet seat engagement portion further comprising a thong coupler extending distally from the retention bar between a first receiver and a second receiver.

12. The apparatus of claim 11, the thong coupler defining a frustum in cross-section.

13. The apparatus of claim 1, the one or more barbs to permit dispersible sheets or human waste to pass when the toilet is flushed.

14. The apparatus of claim 1, the non-dispersible sheets manufactured from one of needlepunched material or spunlace material.

15. A system, comprising:
- an apparatus for a toilet, comprising:
  - a toilet seat engagement portion comprising a retention bar and a thong coupler extending distally from the retention bar;
  - a sheet catcher comprising one or more barbs; and
  - a flexible thong coupling the thong coupler of the toilet seat engagement portion to the sheet catcher;
  - the sheet catcher to situate within a water seal of the toilet when the toilet seat engagement portion engages a toilet seat; and
  - the one or more barbs to catch non-dispersible sheets when the toilet is flushed.

16. The system of claim 15, further comprising one or more of signs or stickers packaged with the apparatus, the one or more of signs or stickers comprising signs instructing a user not to flush the non-dispersible sheets.

17. The system of claim 15, further comprising one or more of signs or stickers packaged with the apparatus, the one or more of signs or stickers comprising one or more stickers to attach to the toilet, the one or more stickers comprising a notice that the toilet is equipped with the apparatus.

18. A method, comprising:
- disposing a sheet catcher in a water seal of a toilet, wherein the sheet catcher comprises at least four barbs spaced apart from each other about an axis of the sheet catcher;
- attaching a toilet seat engagement portion to a toilet seat of the toilet; and
- catching non-dispersible sheets with one or more barbs of the sheet catcher when the toilet is flushed.

19. The method of claim 18, further comprising permitting one or more of human waste or dispersible sheets to pass when the toilet is flushed.

20. The method of claim 18, further comprising replacing the sheet catcher after it catches a non-dispersible sheet.

* * * * *